United States Patent [19]

Tsuchie

[11] Patent Number: 4,464,214

[45] Date of Patent: Aug. 7, 1984

[54] METHOD OF MAKING KITS FOR CARVING REPRODUCTION

[76] Inventor: Osamu Tsuchie, 5-5, Honcho 1-chome, Nakano-ku, Tokyo, Japan

[21] Appl. No.: 454,954

[22] Filed: Jan. 3, 1983

[30] Foreign Application Priority Data

Jan. 29, 1982 [JP] Japan ..... 57-11773

[51] Int. Cl.[3] ..... A41G 00/00

[52] U.S. Cl. ..... 156/61; 144/346

[58] Field of Search ..... 428/542.2, 15, 16, 18; 156/61, 155, 250; 144/345, 346, 350, 351

[56] References Cited

U.S. PATENT DOCUMENTS 2,577,270 12/1951 Riley ..... 428/16
2,725,234 11/1955 Coble et al. ..... 428/16
3,301,725 1/1967 Frontera ..... 428/542.2

OTHER PUBLICATIONS

Advertisement from "Fujior Hyakka" Magazine, published in Japan by N.H.K. Dec. 1, 1979, pp. 12–13 pertinent.

*Primary Examiner*—W. D. Bray
*Attorney, Agent, or Firm*—Blodgett & Blodgett

[57] ABSTRACT

A method of making a kit of component pieces of board to be assembled, joined, and finished to reproduce a carving comprises the steps of joining a given number of pieces of board having substantially the same thickness into a multilayer block with an adhesive readily soluble in a solvent, carving the block into an original figure, dissolving the adhesive away from the block with the solvent and thereby separating the block into contoured pieces of board, tracing the contours of the separate pieces on a drawing paper, and then blanking or otherwise cutting a set of reproduced pieces out of a board in accordance with the drawing.

4 Claims, 6 Drawing Figures

METHOD OF MAKING KITS FOR CARVING REPRODUCTION

BACKGROUND OF THE INVENTION

This invention relates to a method of making kits comprising a set of component pieces of board to be assembled, joined, and finished to reproduce a carved figure or image.

Sculpture is an art of carving or engraving a mass of stone, wood, plaster or other material with chisels or other tools into a desired work of art. In reality, three-dimensional objects of art are difficult to make for amateurs. Those who simply desire to carve a figure of doll, animal, or still life can hardly put the idea into practice.

An apparently easy approach is reproducing an existing sculpture or carving, and some reproduction techniques are known including division of the original into component pieces. However, quantity production of the sets of component pieces is not easy. There are a few possible methods of making them. For example, contour lines of an original are drawn by an optical instrument and are projected on paper for die designing, or the original is sliced into pieces of equal thickness and the resulting slices are placed on paper so that their contours can be drawn for die designing. Thus, in one way or another, a plurality of original drawings are obtained and are used in either making punches and dies for blanking reproduced component pieces out of a board or jigsawing the pieces from the material. However, those methods require too much labor, cost, and equipment for commercial production of kits for carving reproduction which must of necessity be in relatively small lots of countless varieties.

BRIEF SUMMARY OF THE INVENTION

The present invention is aimed at providing a method of making kits for carving reproduction which permit the beginners to make replicas easily with full satisfaction of their desire for artistic creation and representation.

Each kit made by the method of the invention comprises a set of component pieces of board (e.g., of wood, felt, plastics, or paper) having substantially the same thickness but varied in contours. For the purposes of the invention the pieces of board in kits obtained from a single original carving are called "reproduced component pieces" and a complete set for reproduction is called a "kit for carving reproduction".

The component pieces of board in a kit are assembled and joined together, one over another in the order instructed, with or without the aid of some aligning or centering means. In this way a roughly shaped round or preform resembling the particular original is assembled with ease. Then, the beginner further carves or engraves the preform, following a prescribed procedure, simply to obtain a replica generally similar to the original. Although the preform has certain limitations in configuration because of the original image, considerable modifications are possible as desired. This adds a great artistic charm to the kit.

Briefly, the present invention is directed to a method of making kits of reproduced component pieces of board with ease, which comprises temporarily joining a plurality of pieces of board having substantially the same thickness together into a multilayer block with an adhesive readily soluble in a solvent, carving the block into a figure, dissolving the adhesive away from the carving with the solvent, thus separating it into the component pieces contoured correspondingly to the sectioned parts of the original, and then making original drawings of the separate components.

The invention will be described in more detail below with reference to the accompanying drawings showing an embodiment thereof.

DETAILED DESCRIPTION OF THE INVENTION

Figure 1:
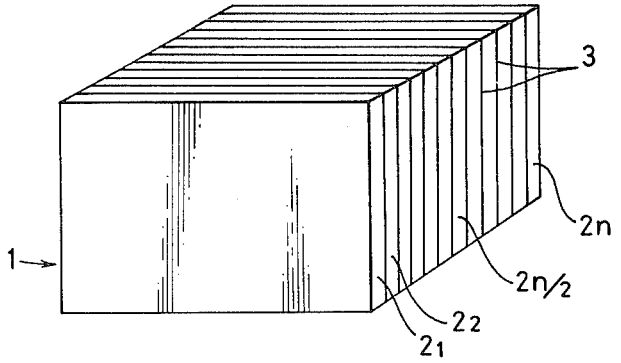
FIG. 1 is a perspective view of a block made in the first step of the method according to the invention.

Referring now to the drawings, specifically to FIG. 1, there is shown a block 1 in the form of a multilayer mass of pieces of board $2_1$, $2_2$,–$2_n$ of teak, balsa or the like, having substantially the same thickness. The pieces of board $2_1$, $2_2$,–$2_n$ are joined together by coating a solvent-soluble adhesive 3 of natural rubber or the like on one side of each piece and placing another piece on the coated surface and so forth. The resulting multilayer block is dried. Bonding agents for woodworking and other similar adhesives should not be employed for this purpose, because they produce such a solid and strong bonds that cannot be dissolved afterwards. High solvent permeability makes balsa board convenient in handling, but where the original carving is relatively complex in shape balsa is too brittle for detail carving and should be abandoned in favor of harder wood, such as teak. With the latter, too, the use of an adhesive of the natural rubber type is advisable since it permeates thoroughly into the wood to the interfaces of the pieces $2_1$, $2_2$,–$2_n$.

In making Buddha statues and the like it is an established practice to glue several blocks of material together, carve the mass into a desired statue, dip the statue into a bath of hot water to separate it into component blocks, and make an enlarged statue with reference to the separate blocks. The practice cannot be incorporated in the present invention, however, because the pieces of board to be employed in the invention are of thicknesses such that the separation of the assembled pieces in hot water and the subsequent drying would cause distortions which make the pieces unfit for use in original drawing.

Figure 2:
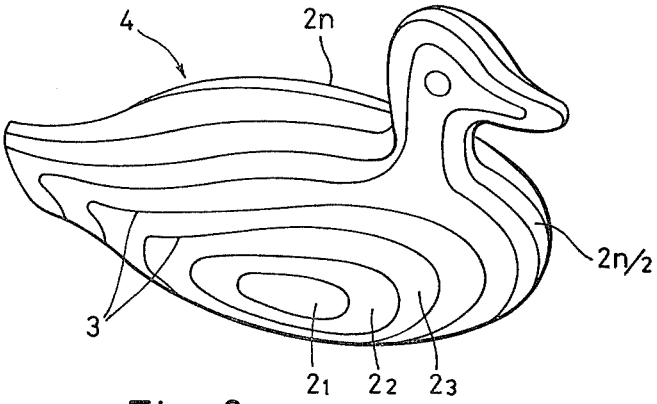
FIG. 2 is a perspective view of an original carving made in the second step of the present method.

Next, the multilayer block 1 formed in accordance with the invention is carved by a known technique into a figure as shown in FIG. 2. The carving, which is to serve as an original for the subsequent reproduction process, is hereinafter referred to as the "original" 4. A work of art, the original may take any desired form, e.g., that of a flower, animal, bird, or human being.

Figure 3:
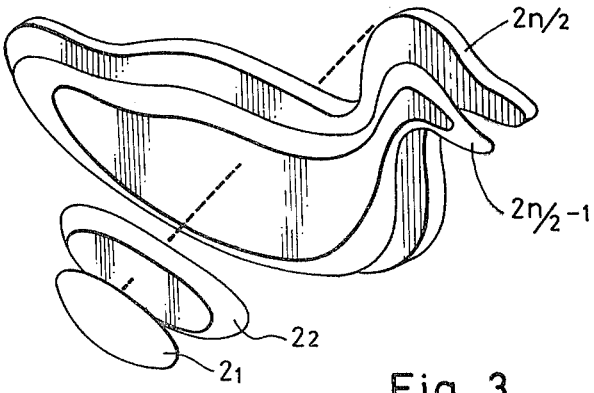
FIG. 3 is a perspective view of part of the original separated into component pieces in the third step.

The original 4 thus perfected is then dipped in or sprayed with a solvent so that the solvent can reach the joined surfaces of the pieces $2_1$, $2_2$,–$2_n$ and dissolve the adhesive to separate the original into individual pieces $2_1$, $2_2$,–$2_{n/2}$ as in FIG. 3. The solvent, an organic substance, is highly volatile at ordinary temperature and has no possibility of distorting the pieces of board.

Figure 4:
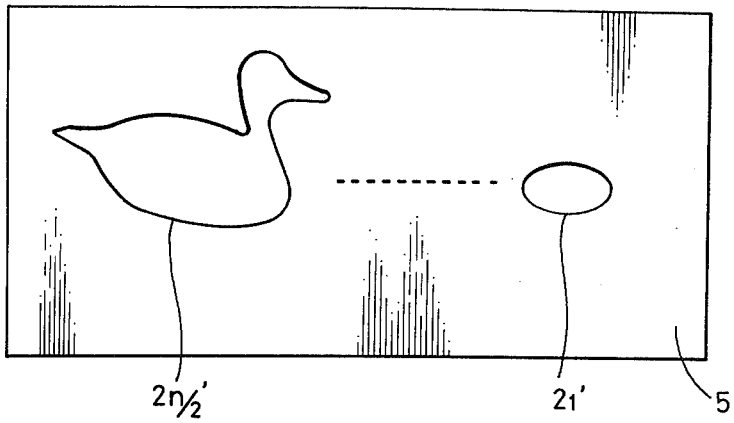
FIG. 4 is a plan view of paper illustrating the original drawing step according to the invention.
Figure 5:
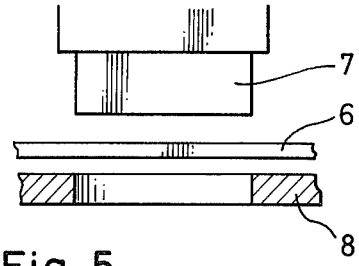
FIG. 5 is a fragmentary sectional view illustrating the step of blanking a component piece out of board for carving reproduction according to the invention.

The separate pieces $2_1$, $2_2$,–$2_{n/2}$ are placed on a drawing paper 5 as in FIG. 4, and their contours $2_1'$, $2_2'$,–$2_{n/2}'$ are traced on the paper. In this case, the pieces of board $2_1$, $2_2$,–$2_n$ are symmetrically located at mirror image positions as divided by the longitudinal, vertical center plane of the original 4. Copying the outlines of the one half, viz., the pieces $2_1$, $2_2$,–$2_{n/2}$, will therefore suffice for the purpose. With an asymmetrically shaped carving, of course, all the component pieces should be copied. In the case of a symmetrical object having a piece of board in the center that occupies the longitudinal center plane, it is necessary to draw the contours of both the center piece and the component pieces on either side.

Figure 6:
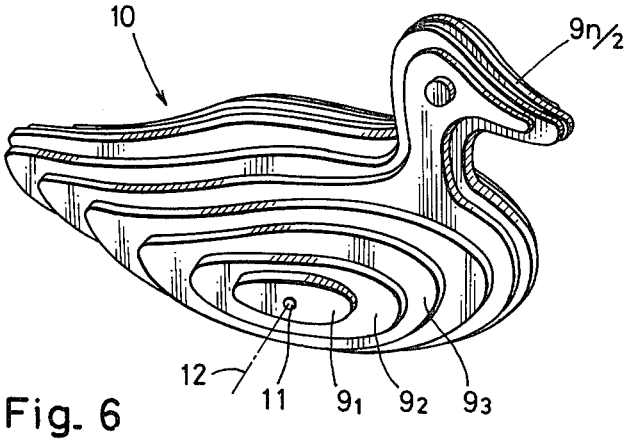
FIG. 6 is a perspective view of a roughly shaped carving or preform obtained in conformity with the invention.

Then, a plurality of blanking units are made in accordance with the drawing shown in FIG. 4. Between those units each consisting of a punch 7 and a die 8 made in this way a broad piece of board 6 of balsa, teak, paperboard, or synthetic wood (e.g., artificial wood of plastic foam or felt) is placed and blanked to give reproduced component pieces $9_1$, $9_2$,–$9_{n/2}$. The blanks thus obtained have edges not curved or rounded as those of the pieces $2_1$, $2_2$,–$2_n$ that constitute the original 4 but cut off at right angles to the plane of the board. The reproduced pieces $9_1$, $9_2$,–$9_{n/2}$ correspond to the component pieces $2_1$, $2_2$,–$2_{n/2}$ of the original 4, and therefore they are combined with another set to make up a complete set of component pieces for carving reproduction (FIG. 6).

A large number of the sets as mass-produced kits of component pieces, unglued and separate, can be put on the market. One who has purchased the kit as a hobby assembles and joins the reproduced component pieces $9_1$, $9_2$,–$9_{n/2}$,–$9_n$, in the order directed, with an adhesive for woodworking, until a roughly shaped carving or preform 10 as shown in FIG. 6 is formed. The purchaser can obtain a replica substantially the same as the original by carving the preform on a certain principle, viz., by carving it obliquely inward from one corner or the outer extremity of one joined interface between two pieces to another, thus removing the steplike outer protrusions and providing a smooth, integral configuration. When desired, the preform 10 may be modified by carving otherwise to a preferred shape.

Also, if desired for the facility of assembling, the reproduced pieces in a set may have a small through hole 11 each, formed at a proper point, e.g., along the chain line 12 to bring all the components into registry with each other. The set of holed pieces may be combined with a centering or aligning pin of wood, plastics, metal or the like, and a suitable adhesive, so that the combination can be put on sale as a complete kit.

While the present invention has been described as embodied in making reproduced component pieces by means of blanking punches and dies, it will be understood by those skilled in the art that the foregoing and other changes, such as the use of jigsaws or other tools instead in accordance with the drawing, can be made therein without departing from the spirit and scope of the invention.

What is claimed is:

1. A method of making a kit of component pieces of board to be assembled and joined together for carving reproduction, which comprises joining a given number of pieces of board having substantially the same thickness into a multilayer block with an adhesive readily soluble in a solvent, carving said block into an original figure, dissolving said adhesive away from said block with said solvent and thereby separating said block into contoured pieces of board, tracing the contours of said separate pieces on a drawing paper, and then blanking or otherwise cutting a set of reproduced pieces out of a board in accordance with said drawing.

2. A method according to claim 1 wherein said step of blanking or otherwise cutting a set of reproduced pieces out of a board consists of making a plurality of sets of punches and dies in conformity with said drawing and blanking therewith said reproduced pieces out of a board.

3. A method according to claim 1 or 2 wherein said pieces of board are solvent-permeable.

4. A method according to claim 3 wherein said reproduced pieces is made of a carvable material selected from among boards of veneer, balsa, teak and other wood, stone slabs, boards of felt, paper, and plastics and the like.

* * * * *